United States Patent [19]

Nakanishi

[11] 4,270,768

[45] Jun. 2, 1981

[54] SKI AND A PROCESS FOR MANUFACTURING SAME

[75] Inventor: Tatsuo Nakanishi, Hamamatsu, Japan

[73] Assignee: Nippon Gakki Seizo Kabushiki Kaisha, Japan

[21] Appl. No.: 928,380

[22] Filed: Jul. 26, 1978

[30] Foreign Application Priority Data

Aug. 1, 1977 [JP] Japan ..... 52/91376
Aug. 16, 1977 [JP] Japan ..... 52/97970

[51] Int. Cl.[3] ..... A63C 5/12
[52] U.S. Cl. ..... 280/610
[58] Field of Search ..... 280/610, 601

[56] References Cited

U.S. PATENT DOCUMENTS 3,635,483 1/1972 Barriball et al. ..... 280/610

FOREIGN PATENT DOCUMENTS 2506289 8/1976 Fed. Rep. of Germany ..... 280/601
2210986 9/1973 Fed. Rep. of Germany ..... 280/610
2602652 7/1977 Fed. Rep. of Germany ..... 280/610

*Primary Examiner*—John J. Love
*Assistant Examiner*—Milton L. Smith
*Attorney, Agent, or Firm*—Ostorlenk, Faber, Gerb & Soffen

[57] ABSTRACT

In a construction of a ski having patterns visible on the bottom, the sole board is made up of a transparent polyethylene resin sheet and a thermoplastic synthetic resin composite sheet sandwiched between the polyethylene resin sheet and the main body of the ski, the patterns being formed on the mating surface of the composite sheet with the polyethylene resin sheet. In manufacturing, a composite film having patterns printed thereon is successively combined with a polyethylene resin sheet by pressure fusion at high temperature. Reduced thickness of the sole board with high masking effect, omission of the wet system painting conventionally used for masking layer formation, and employment of the economically advantageous photogravure printing of the patterns can be expected.

8 Claims, 6 Drawing Figures

SKI AND A PROCESS FOR MANUFACTURING SAME

BACKGROUND OF THE INVENTION

The present invention relates to an improved ski and a process for manufacturing same, and more particularly relates to improvement in the sole board construction of a ski having patterns visible on the bottom and in the process for manufacturing sole boards of such an improved construction.

Lately, there are increasing number of skis on the market which have various patterns such as trademarks or decorations visible not only on the top but also on the bottom surface of a ski.

In the conventional construction of a ski of this type, a masking layer generally made of pigment is provided between the main body and a sole board of the ski in order to mask the relatively rough texture of the lower surface of the main body and presence of the sole edges. The sole board is in general made of transparent polyethylene resin and the above-described patterns are printed on the mating surface of the sole board with the masking layer.

With this construction, a relatively large thickness is required for the masking layer in order to obtain sufficient masking effect and such an increased thickness of the masking layer causes the ski to be heavy which makes the ski unsuited for transportation and inhibits easy maneuver of the ski. The presence of the thick masking layer tends to cause undesirable accidental separation of the sole board from the main body during skiing. Further, the relatively thick and relatively rigid construction of the sole board does not allow employment of economical photogravure printing for formation of the patterns thereon. For this reason, formation of the patterns needs to depend upon screen printing which is very disadvantageous in cost and efficiency when compared with photogravure printing. Further, formation of the masking layer is carried out by a wet process which is in general very disadvantageous in operational efficiency.

SUMMARY OF THE INVENTION

It is one object of the present invention to provide a ski having patterns visible on the bottom in which the sole board is remarkably small in thickness.

It is another object of the present invention to provide a ski having patterns visible on the bottom which does not require provision of a masking layer.

It is another object of the present invention to provide a ski having patterns visible on the bottom in which component sheets making up the sole board are strongly combined with each other.

It is a further object of the present invention to provide a process for manufacturing a ski having patterns visible on the bottom in which the patterns can be formed by economically advantageous photogravure printing.

It is a still further object of the present invention to provide a process for manufacturing a ski having patterns visible on the bottom which is quite free of the wet process used in the conventional process for formation of the masking layer.

DESCRIPTION OF PREFERRED EMBODIMENT

Figure 1:
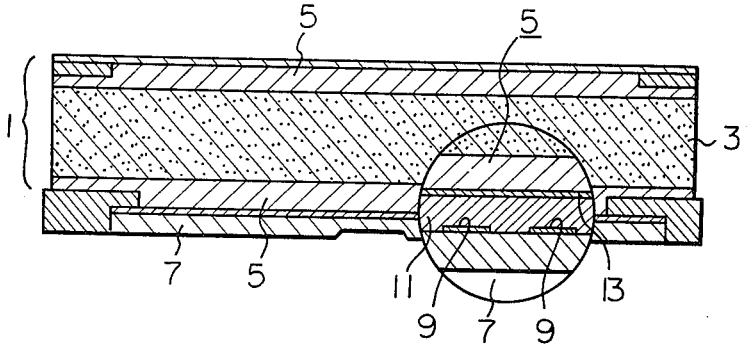
Fig. 1 PRIOR ART
FIG. 1 is a transverse cross sectional view shown partly enlarged in a circle, of the conventional ski having patterns visible on the bottom.

One typical example of the internal construction of the conventional ski is shown in detail in FIG. 1, in which the ski includes a main body 1 comprised of a core 3 and reinforcement boards 5 sandwiching the core 3. A sole board 7 forms the bottom of the ski and it is in the form of a transparent polyester resin sheet on which desired patterns 9 are printed. An opaque masking layer 11 containing a pigment or pigments is combined to the upper surface of the sole board 7 and is further coupled to the bottom surface of the lower reinforcement board 5 via a bonding layer 13. The pigment mixed in the masking layer 11 has a tone color which is effective for setting off the patterns 9 printed on the sole board 7 and masking the bottom face of the lower reinforcement board 5. Epoxy resin paints or coatings are generally used for the masking layer 11.

The thickness of the sole board 7 should be in a range from 1.0 to 2.0 mm. in order to afford sufficient mechanical strength to the ski. Since the patterns 9 are printed on the sole board 7 and the sole board 7 is relatively rigid due to its relatively large thickness, it is almost impossible to form the patterns 9 by photogravure printing which is very advantageous in printing cost. Thus, formation of the patterns 9 is usually carried out by screen printing which is disadvantageous in printing cost. In addition, it is required to apply proper additional treatment such as oxidation treatment to the printed surface.

A further disadvantage is caused by the process for forming the masking layer 11. The masking layer 11 is formed by a wet system in which epoxy resin paints including the abovedescribed pigment or pigments are coated on the face of the sole board 7. This wet system is very low in process efficiency and leads to increased manufacturing cost. Further, in order to obtain sufficient masking effect, it is necessary to increase the thickness of the masking layer 11. The increased thickness of the masking layer 11 is added to the above-described relatively thick construction of the sole board 7 and this causes increased weight of the ski and low bonding of the masking layer 11 to the lower reinforcement of the main body 1.

In addition, presence of the patterns 9 on the sole board 7 tends to lower bonding strength between the sole board 7 and the masking layer 11, thereby causing accidental separation of the sole board 7.

Figure 2:
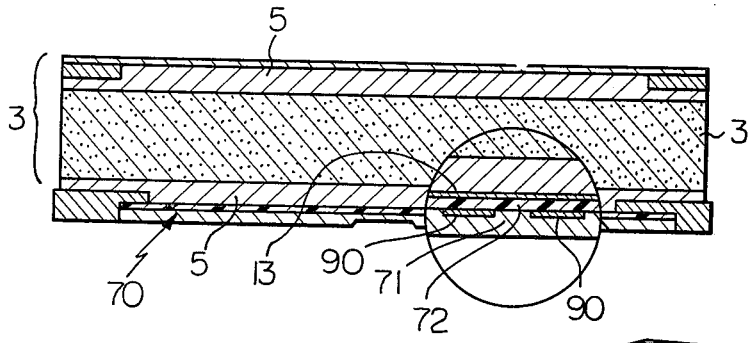
FIG. 2 is a transverse cross sectional view shown partly enlarged in a circle, of one embodiment of the ski in accordance with the present invention.

An embodiment of the ski in accordance with the present invention is shown in FIG. 2, in which parts substantially similar to those used in the construction shown in FIG. 1 are designated by common reference numerals.

Figure 3A:
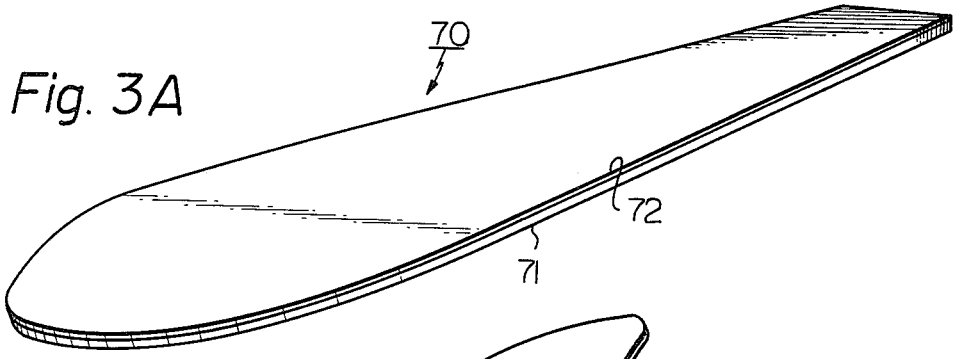
FIGS. 3A and 3B are explanatory perspective views showing the construction of the sole board used in the ski shown in FIG. 2.
Figure 3B:
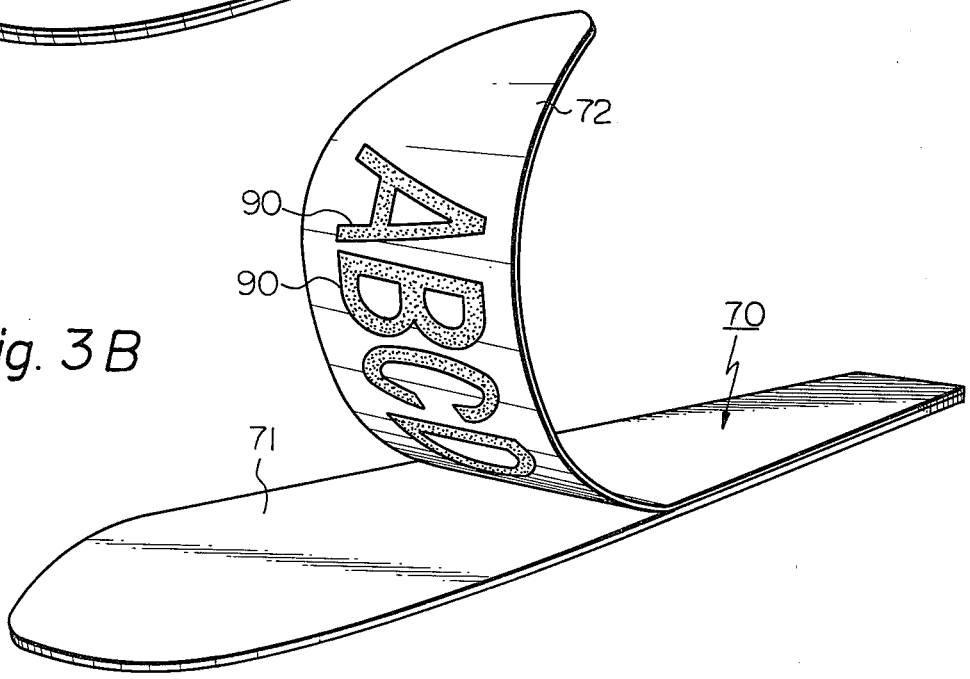

In the construction shown in FIG. 2, a sole board 70 is made up of a polyethylene resin sheet 71 and a thermoplastic synthetic resin composite sheet or film 72 (hereinafter referred to simply as "a composite sheet") which are superimposed and fused to each other as shown in FIG. 3A. Patterns 90 are provided on the surface of the composite sheet 72 mating with the polyethylene resin sheet 71 as shown in FIG. 3B.

The composite sheet 72 is made of a mixture of polyethylene resin, ethylene-vinyl acetate copolymer resin, and filler.

A polyethylene resin having a melt index in a range from 0.1 to 2 dg/min and an ethylene-vinyl acetate copolymer resin having a melt index from 0.2 to 100 dg/min are advantageously used in combination with each other. 5 to 50 parts by weight of the copolymer resin is mixed with 100 parts by weight of polyethylene resin. The filler may preferably take the form of a granular filler chosen from a group consisting of (a) silicic acid filler, and (b) inactive metallic oxide, carbonate and sulfate fillers, and/or include thermoplastic non-variable polystyrene resin filler. The mixing ratio of the filler may preferably be in a range from 5 to 50 parts by weight with respect to 100 parts by weight of polyethylene resin. The particle size of the filler may preferably be in a range from 0.1 to 20$\mu$, and more preferably in a range from 0.5 to 10$\mu$.

When the composite sheet 72 is provided with the above-described chemical and physical compositions, the composite sheet 72 has satisfactory masking effect, ideal surface smoothness, excellent affinity to the ink used for the patterns 90 and enhanced thermal fusion to the polyethylene resin sheet 71.

In a preferred embodiment of the present invention, the ink used for printing the patterns 90 may contain at least one polyethylene resin powder for increased bonding between the patterns 90 and the polyethylene resin sheet 71. Similar effect can be obtained by using ethylene-vinyl copolymer type ink, chlorinated polypropylene type ink or polybutyral type ink.

Figure 4:
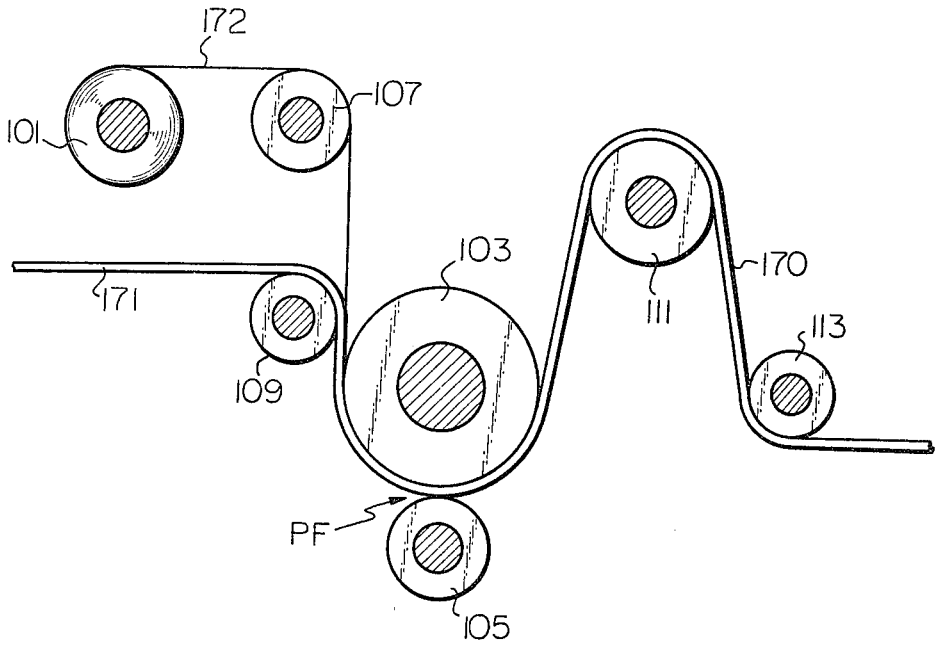
FIG. 4 is a side view for showing one embodiment of the process of the present invention.

One embodiment of the process for manufacturing the ski in accordance with the present invention is shown in FIG. 4, in which a thermoplastic synthetic resin composite film 172 is delivered from a supply roll 101. The thickness of the composite film 172 is in a range from 50 to 200 m$\mu$ and suitable patterns 90 (see FIG. 3B) are already formed on the mating surface of the composite film 172 by photogravure printing. The composite film 172 is led to a pressure fusing nip PF between a pair of press rollers 103 and 105 via a guide roller 107. Concurrently with this, a polyethylene resin sheet 171 is led to the pressure fusing nip PF via a guide roller 109. In the case of the illustrated embodiment, the polyethylene resin sheet 171 is led to the pressure fusing nip PF directly after extrusion and in a high temperature condition. Thickness of the polyethylene resin sheet is in a range from 1.0 to 2.0 mm. The composite film 172 is pressed against and fused to the polyethylene sheet 171 during their passage through the pressure fusing nip PF. This pressure fusion is carried out preferably at a temperature in a range from the melting point of the polyethylene resin to a temperature higher than the melting point by about 120° C., the melting point being in general in a range from 110° to 120° C.

Figure 5:
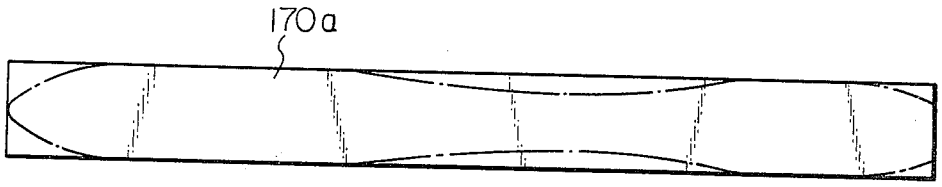
FIG. 5 is a top view of a unit piece which may be trimmed to define the ski of the present invention.

After the pressure fusion, an elongaged combined sheet 170 thus obtained is processed to the next station (not shown) via guide rollers 111 and 113, at which the elongated combined sheet 170 is cut into unit pieces 170*a* of a prescribed length and trimming is applied to the unit pieces as shown with phantom lines in FIG. 5 in order to obtain skis having the internal construction shown in FIG. 2.

It is not always required to supply the polyethylene resin sheet 171 to the pressure fusing nip PF directly after the extrusion. It is also possible to have the sheet cooled after extrusion and subjected to flame oxidation treatment and heating prior to its supply to the pressure fusing nip PF.

In accordance with the ski of the present invention, presence of the vinyl acetate component in the thermoplastic synthetic resin composite sheet causes enhanced affinity of the pattern ink to the composite sheet. In addition, presence of the filler in the composite sheet affords excellent masking effect despite the remarkably thin construction of the composite sheet. This leads to a remarkably reduced thickness of the sole board, thereby eliminating drawbacks resulting from the conventional heavy construction thereof. Further, presence of the polyethylene component in the composite sheet greatly assists thermal fusion of the composite sheet with the polyethylene resin sheet, thereby obtaining a sole board in which the component sheets are very strongly bonded to each other.

In accordance with the process of the present invention, it is no longer required to form the thick masking layer on the sole board, thereby eliminating drawbacks caused by the wet system treatment. Further, the relatively thin and flexible nature of the composite sheet allows trouble free employment of photogravure printing for formation of the patterns on the composite sheet, which is very advantageous in cost and process efficiency.

I claim:

1. An improved ski comprising a main body;

a sole board bonded to the bottom of said main body; and at least a pattern provided within said sole board;

said sole board being made up of a transparent polyethylene sheet defining the bottom surface of said ski, and a thermoplastic synthetic resin composite sheet sandwiched between said main body and said polyethylene resin sheet; said composite sheet contains polyethylene resin, ethylene-vinyl acetate copolymer resin and filler;

said pattern is formed on the mating surface of said composite sheet with said polyethylene sheet.

2. An improved ski as claimed in claim 1 in which the content ratio is 100 parts by weight for said polyethylene resin, 5 to 50 parts by weight for said ethylene-vinyl acetate copolymer resin, and 5 to 50 parts by weight for said filler.

3. An improved ski as claimed in claim 1 in which the melt index for said polyethylene resin is in a range from 0.1 to 2 dg/min.

4. An improved ski as claimed in claim 1 in which the melt index for said ethylene-vinyl acetate copolymer is in a range from 0.2 to 100 dg/min.

5. An improved ski as claimed in claim 1 in which said filler is a granular filler taken from a group consisting of silicic acid fillers, inactive metallic oxide filler, carbonate filler and sulfate filler.

6. An improved ski as claimed in claim 1 in which said filler is thermoplastic non-variable polystyrene resin.

7. An improved ski as claimed in claim 5 or 6 in which the particle size of said filler is in a range from 0.1 to 20.

8. An improved ski as claimed in claim 7 in which said particle size is in a range from 0.5 to 10$\mu$.

* * * * *